US005178678A

United States Patent [19]

Koehler et al.

[11] Patent Number: 5,178,678

[45] Date of Patent: Jan. 12, 1993

[54] RETRACTABLE COATER ASSEMBLY INCLUDING A COATING BLANKET CYLINDER

[75] Inventors: Jamie E. Koehler, Montreal, Canada; James E. Taylor, Dallas, Tex.; Mark A. DiRico, Quincy, Mass.

[73] Assignee: Dahlgren International, Inc., Carrollton, Tex.

[21] Appl. No.: 544,996

[22] Filed: Jun. 27, 1990

Related U.S. Application Data

[63] Continuation-in-part of PCT/US90/03338, filed Jun. 13, 1990, which is a continuation-in-part of Ser. No. 365,680, Jun. 13, 1989, Pat. No. 4,934,305.

[51] Int. Cl.[5] ..... B05C 1/08; B05C 1/02

[52] U.S. Cl. ..... 118/46; 101/177; 101/178; 118/211; 118/224; 118/262; 427/407.1; 427/558

[58] Field of Search ..... 101/177, 178, 147, 146; 118/46, 211, 262, 224, 249; 427/54.1, 407.1

[56] References Cited

U.S. PATENT DOCUMENTS

| | | | |
|---|---|---|---|
| 2,279,204 | 4/1942 | Neilson | 101/415.1 |
| 2,320,523 | 6/1943 | Jirousek | 118/262 |
| 3,397,675 | 8/1968 | Deligt | 118/258 |
| 3,536,006 | 10/1970 | Roozee | 101/137 |
| 3,768,438 | 10/1973 | Kumf | 118/262 |
| 3,800,743 | 4/1974 | Egnaczak | 118/259 |
| 3,916,824 | 11/1975 | Knodel et al. | 118/224 |
| 4,222,325 | 9/1980 | Edwards | 101/137 |
| 4,270,483 | 6/1981 | Butler et al. | 118/46 |
| 4,308,796 | 1/1982 | Satterwhite | 101/143 |
| 4,372,244 | 2/1983 | Rebel | 118/46 |
| 4,379,039 | 4/1983 | Fujimoto et al. | 204/159.15 |
| 4,396,650 | 8/1983 | Lange et al. | 427/407.1 |
| 4,420,541 | 12/1983 | Shay | 427/54.1 |
| 4,451,509 | 5/1984 | Frank et al. | 427/54.1 |
| 4,524,712 | 6/1985 | Ito | 118/46 |
| 4,574,732 | 3/1986 | Verway et al. | 118/46 |
| 4,586,434 | 5/1986 | Tokuno et al. | 101/178 |
| 4,615,293 | 10/1986 | Jahn | 118/46 |
| 4,685,414 | 8/1987 | DiRico | 118/46 |
| 4,704,296 | 11/1987 | Leanna et al. | 118/262 |
| 4,706,601 | 11/1987 | Jahn | 118/46 |
| 4,753,166 | 6/1988 | Fischer | 101/349 |
| 4,779,557 | 10/1988 | Frazzita | 118/46 |
| 4,796,556 | 1/1989 | Bird | 118/46 |
| 4,815,413 | 3/1989 | Kota | 118/46 |
| 4,825,804 | 5/1989 | DiRico et al. | 118/262 |
| 4,841,903 | 6/1989 | Bird | 118/46 |
| 4,852,515 | 8/1989 | Terasaka et al. | 118/663 |
| 4,854,232 | 8/1989 | Oda | 101/211 |
| 4,889,051 | 12/1989 | Sarda | 101/177 |
| 4,936,211 | 6/1990 | Pensavecchia et al. | 101/177 |

FOREIGN PATENT DOCUMENTS

| | | |
|---|---|---|
| 482797 | 4/1952 | Canada . |

*Primary Examiner*—Willard Hoag

[57] ABSTRACT

An addition to a multi-color lithographic offset printing press comprising a self-contained coating unit moveable into and out of operative relationship with an impression cylinder on the press unit (e.g. the impression cylinder of the last press unit) without interrupting or disrupting printing taking place in this last stage. The coating unit includes a special blanket cylinder, a transfer cylinder and doctor or metering means to control the amount of coating material on the transfer cylinder. Inclined tracks are provided to guide the coating unit into and out of operative relationship with the impression cylinder of the last printing stage.

49 Claims, 10 Drawing Sheets

ONE SIDE PRINTING/
TOP COATING

TWO SIDE PRINTING/
SIDE COATING

RETRACTABLE COATER ASSEMBLY INCLUDING A COATING BLANKET CYLINDER

BACKGROUND OF THE INVENTION

This application is a continuation-in-part of PCT/US 90/03338 filed Jun. 13, 1990, which in turn was a continuation-in-part of U.S. Ser. No. 365,680, filed Jun. 13, 1989 and now U.S. Pat. No. 4,934,305.

This invention relates to coating printed workpieces, e.g. sheets. It more particularly refers to a process and apparatus for coating workpieces which have been printed on offset printing equipment.

In many applications it is desirable to apply a spot or overall coating to a printed workpiece. For example, a UV curable or water-soluble polymer finish may be applied to a workpiece printed by offset lithography. The coating is quickly dried while the surface of the ink is still tacky. This coating avoids the need for powder driers sprayed between sheets to present offsetting of oxidation-dried inks that are slow to dry. These coatings are also useful for providing a glossy finish that improves the rub-resistance of the workpiece and improves its overall appearance and feel. Finally, adhesive coatings may be applied to printed packaging; for example, heat-set adhesives may be applied to enable attachment of a feature such as clear plastic bubble of a package used to display the product. It is said that ultraviolet-cured and aqueous overprint coatings are, by some measurements, the fastest growing segments of the printing industry.

Application of coatings to a workpiece is made difficult by various requirements. For example, the coating should be uniform and its thickness should be controlled. Moreover, the aqueous coating should be applied quickly, before its vehicle evaporates causing it to thicken. Finally, it is desirable for the coater to operate "in-line" with the press that prints the workpiece to take full advantage of the fast-drying capability of coatings and generally to simplify the manufacture of printed coated workpieces.

Butler U.S. Pat. No. 4,270,483 discloses an in-line coating apparatus for attachment to a conventional offset lithographic printing press. The apparatus includes a set of rollers (i.e., pick-up roller 14 and application roller 16) to deliver coating material from a reservoir 18 to a standard press unit blanket roll 108. A metering rod 40 meters the amount of coating transferred to application roller 16.

An in-line coater sold by Norton Burdett Co. of Nashua, N.H. has a single roller driven directly by a D.C. motor. The roller is a gravure cylinder that transfers coating to a standard press unit blanket cylinder. The coater is attached to a pivoting arm, and the unit can be pivoted away from the press unit when the coater is not in use.

Another in-line coater, sold by IVT Colordry, Inc. of Fairfield, Conn., applies coating from a reservoir pan to a standard press unit blanket cylinder using a pick-up roller that delivers a coating supply to an applicator roller; the applicator roller applies the coating to the blanket cylinder of a press unit.

Kumpf U.S. Pat. No. 3,768,438 discloses a coater in which a fountain roller dips into a coating reservoir and transfers liquid coating material to a feed roller. The feed roller in turn transfers coating material to a coating roller that coats a sheet fed between the coating roller and a format roller.

DiRico U.S. Pat. No. 4,685,414 discloses a process and apparatus for use in combination with an existing press unit wherein the coating means is retractable, to be used or not as the printer requires. In this device, the coating means utilizes the blanket roll of the last unit of the press, and this last unit cannot be used for color application means when it is used for coating. For example in a four color press, utilizing the coating apparatus of the '414 patent would then permit only three colors to be printed in in-line, single pass operation.

Bird U.S. Pat. No. 4,796,556 discloses an offset lithographic apparatus with a plate cylinder and a blanket cylinder, and an in-line coater to apply liquid coatings either in a pattern or over the entire workpiece. The apparatus has a carriage which moves the coater between a first position operative association with the plate cylinder of the lithographic press unit (see full line of unit 72 in FIG. 1) and a second position in operative association with the blanket cylinder of the lithographic press unit (see broken line of unit 72 in FIG. 1). In the first position the coater applies spot coating, and in the second position the coater applies coating over the entire sheet.

Satterwhite U.S. Pat. No. 4,308,796 discloses apparatus for adapting an offset lithographic press to flexographic operations, the flexographic operation being either for coating or printing. Coating is achieved by applying a photosensitive plate to the lithographic blanket roll of the offset press. A transfer roll supplies coating to the plate. Inking is achieved in a like manner but with a flexographic plate having raised image areas.

Makosch U.S. Pat. No. 4,397,237 discloses a pivoting secondary inking system ("B" in FIG. 2).

Preuss et al. U.S. Pat. No. 3,391,791 discloses a sheet coater which moves into engagement with various cylinders in a press delivery area.

Knodel et al. U.S. Pat. No. 3,916,824 discloses a coating assembly which includes a fountain roll, a metering roll and an applicator roll for coating band of ribbon material. The coater is horizontally displaceable on an auxiliary frame.

Jahn U.S. Pat. No. 4,615,293 and 4,706,601 disclose separate duplex coating units disposed downstream of a printing press. The units permit coating of selected portions of the workpiece using a relief plate or permit blanket coating.

Switall U.S. Pat. No. 4,617,865 discloses a coater that can be pivoted into and out of position in contact with the blanket cylinder of the press unit; the coater being retractable with the same limits as that of the Di Rico device, i.e., the coating and printing functions cannot be performed simultaneously.

Jirousek U.S. Pat. No. 2,320,523 discloses a self-adjusting dampening roll.

Edwards U.S. Pat. No. 4,222,325 discloses a retractable dampening and inking unit.

Egnaczak U.S. Pat. No. 3,800,743 discloses a coater for a photoelectrophoretic process.

DeLigt U.S. Pat. No. 3,397,675 discloses a coating or printing station having its applicator and transfer rolls attached to pivotally mounted supporting frames.

Some commercial presses, such as Heidelberg GTO and MO include an extra blanket cylinder e.g., for numbering, printing extra colors, perforating, center slitting, etc. This added cylinder is a fixed part of the press, and does not retract with associated equipment for numbering or imprinting.

SUMMARY OF THE INVENTION

This invention generally features a coating apparatus that operates on line with an impression cylinder of a lithographic printing press to apply a liquid coating to a workpiece. The invention is particularly (but not exclusively) adapted to sheet-fed lithographic presses. The coating apparatus of the invention has an integrated, independent, cooperatively operating, coating assembly whose components include a liquid coating supply means, a special coating blanket cylinder (in addition to any blanket cylinder(s) that are already part of the press), and means for metering and transferring coating material operatively connected to the coating blanket cylinder and to the liquid coating supply means, for controlling the amount of coating supplied onto the coating blanket cylinder from the supply means. Structural members integrate the means for metering and transferring coating and the coating blanket cylinder into the coating assembly so that the coating assembly components remain fixed relative to one another as the assembly moves relative to the impression cylinder of the press. The apparatus also includes a means for positively driving the coating blanket cylinder in association with the press unit impression cylinder and mounts for guiding movement of the coating assembly between an operative position, in which the coating blanket cylinder is operatively engaged with the press unit impression cylinder, and an off-imprint (or off-impression) position, in which the coating blanket cylinder and drive is slightly separated from the impression cylinder (i.e., separated sufficiently to prevent contact). In the operative position the coating blanket cylinder can be accurately adjusted relative to the impression cylinder. Moreover, the coating assembly can be actuated so the coating blanket cylinder is slightly separated from the impression cylinder. Such adjustment and actuation are achieved without a change in the coating blanket cylinder position relative to the coating metering and transfer means.

One embodiment of the system is especially adaptable to press types such as the Heidelberg Speedmaster TM line of presses, where there is access between the press blanket cylinder of the last press unit and the sheet transfer cylinder of the delivery to add a blanket cylinder for coating on the impression cylinder of the press unit. In this embodiment, the press impression cylinder which engages the coating assembly is also operatively associated with the printing blanket cylinder on the press. In operation, a sheet on the impression cylinder contacts the printing blanket at a first location on the sheet while it contacts the coating assembly blanket at a second location on the sheet, enabling simultaneous printing and coating at a single impression cylinder.

Alternatively, in other embodiments for presses that cannot accommodate the coating assembly at the press impression cylinder, it is possible to replace (retrofit) a press transfer cylinder with an impression cylinder that can accommodate the coating blanket cylinder of the coating assembly. For example, where the printing press comprises an accessible transfer cylinder, an impression cylinder may be retrofit into a position ordinarily occupied by the transfer cylinder. One version of this embodiment features using the coating assembly at an impression cylinder that has been retrofit in place of a transfer cylinder upstream from a tower coater. In this embodiment, the sheet workpiece is precoated prior to coating at the tower coater.

Yet another preferred embodiment of the invention features retrofitting a fixed coating tower with the coating assembly of the invention. The fixed coater has an impression cylinder operatively connected to a fixed coating blanket cylinder. The coating assembly is retrofit to the fixed coating impression cylinder so that the coating assembly blanket cylinder of the invention and the fixed coating blanket cylinder both operate simultaneously on the fixed coating impression cylinder. In this way, two layers of coating are applied simultaneously to the same workpiece.

The coating blanket cylinder of the coating assembly is adapted to provide a coating surface, which preferably is the generally same basic diameter as the standard printing blanket cylinder. By "adapted to provide a coating surface", we mean that the coating blanket cylinder can receive a standard resilient blanket, or it can receive a relatively hard or resilient relief plate or its equivalent. Alternatively, the cylinder could have a surface with permanent relief. For spot-coating, the coating blanket cylinder carries a photopolymer relief plate or equivalent. This cylinder is also preferably equipped for circumferential and lateral (side) register to enable accurate positioning of the plate. Pin register may also be supplied for pre-positioning of the plate relative to the positions of upstream printing plates. Pin-register may be supplied in lieu of, or, in conjunction with circumferential and side register means. The photopolymer plate may be installed in the same blanket reels or clamps as provided for the blanket, or, may be attached to the cylinder, independent of the blanket clamping provisions. The coating blanket cylinder continuously delivers a smooth, uniform metered amount of liquid coating material to the workpiece carried on the press unit impression cylinder.

Preferred embodiments of the invention are characterized as follows. The mounts guide the coating assembly to move to a fully retracted position in which the assembly and particularly the coating blanket cylinder are completely disengaged from the press unit impression cylinder at a remote location from the press unit cylinders. The coating transfer means comprises a transfer (delivery) cylinder (e.g. an engraved or smooth cylinder) in operative contact with the coating blanket cylinder, as well as a metering means (an elongated blade or a metering roll) for metering the amount of coating carried on the transfer cylinder. The coating assembly is mounted on an inclined support attached to the press frames of the delivery section of the press. Means are provided for moving the coating apparatus toward or away from the press unit. Specifically, these means can include a hydraulic cylinder. Coating is circulated by recirculation means. Coating is supplied between the transfer means and the metering means, flows longitudinally along the length of the transfer and metering means and cascades at the ends thereof to a drip pan positioned below the metering means. A drip pan outlet is in operative association with the recirculation means, and the coating supply means communicates with the recirculation means, to supply recirculated coating to the transfer and metering means. The coating blanket mounted on the blanket cylinder and the press unit blanket cylinder have substantially the same effective operating diameter. The apparatus includes means to control pressure or width of the nip between the transfer cylinder and the coating blanket cylinder. The apparatus also includes means to control the actuation, adjustment and speed of the transfer cylinder relative to the blanket cylinder. A gear is adapted to positively, drivingly, couple the coating blanket cylinder to the impression cylinder when the assembly is in the first (operating) position. This gear can be made of a special plastic material. Additionally, the impression cylinder includes a gear adapted to drive the gear on the coating blanket cylinder. Means are provided for registering the coating blanket cylinder gear with the adjacent impression cylinder gear. Proximity sensors located on the coating blanket cylinder gear and the impression cylinder gear are utilized to rotationally align these gears with one another. The press will not start unless the gears are sensed to be in the proper position relative to each other. The apparatus also includes means for adjusting the coating blanket cylinder relative to the press unit impression cylinder while the two cylinders remain drivingly engaged. An adjustable stop controls the nip between the coating blanket cylinder and the impression cylinder, without changing the relationship between the coating blanket cylinder and the liquid coating metering and transfer means. Specifically, this stop can be a threaded screw. The coating blanket cylinder is preferably lightweight (aluminum) with means enabling lateral and/or circumferential register adjustment relative to the adjacent press impression cylinder. Circumferential register adjustment means includes a plurality of bolts and nuts, as well as correspondingly positioned slots in a plate secured to the coating blanket cylinder, which are adapted to allow for rotational movement of the coating blanket cylinder with respect to the coating blanket cylinder gear. Lateral register adjustment means includes threaded collars adapted to allow for lateral movement of the coating blanket cylinder, located at both ends of said coating blanket cylinder. There is provided a means of locking the coating apparatus to the press unit. Specifically, the means can include a cylinder clevis and a press-mounted lug, cooperatively sized and positioned to engage said clevis, and a releasable latch pin adapted to connect the clevis to the lug. Alternatively, the means can include a pair of cooperatively sized and positioned electromagnets which, when de-energized, allow the coating assembly to be released for movement to a location remote from the press unit.

This invention thus provides a direct coating system for a sheet fed printing press, preferably a multi-color press, and enables in-line printing and coating at the same time on a single press unit, thus maintaining the printing capability of the printing press unit. When a press unit (preferably the final press unit) is retrofitted with the retractable coating assembly of this invention, an existing impression cylinder in the press unit may act as a common impression cylinder, so that ink is first applied to a sheet being fed on the impression cylinder and a coating is applied directly to the sheet over the last ink application. After this dual sequential application of ink and coating onto a sheet on the same impression cylinder, the coating can be suitably dried by air, infra-red heat, ultra-violet radiation or any other means adapted to quickly dry the coating.

This apparatus is capable of delivering a metered amount of coating through a special blanket roll to a sheet carried by the last impression cylinder in a printing press substantially without interrupting or changing the printing process. It allows spot coating or overall coating as may be desired by the printer. It operates without the use of bulky complex metering systems, yet the apparatus is versatile in that the printer can bring the coater in line or not, as he desires, without changing or interfering with an existing printing operation. Adjustment of the coating blanket cylinder and entire assembly is made relative to the impression cylinder to compensate for various sheet thicknesses to be printed. The assembly is furthermore actuatable while still drivingly engageable with the impression cylinder, to on-off positioning of the cylinder when operating in the first position.

The entire apparatus is further retractable to the second position by a simple retraction device, such as a linear-actuator, winch, hydraulic cylinder or the like, up an inclined plane (the same plane as for movement for adjustment and actuation), to provide access to: (1) the coating blanket cylinder for changing blankets, packing, clean-up, maintenance, etc.; (2) the standard printing blanket cylinder; (3) the impression cylinder; and (4) the sheet delivery area, beneath the coating apparatus, housing the conventional Infra-red or UV drying unit. In this second retractable position, the apparatus may be used as a seat by the operator, as desired, for standard printing press unit operation.

A gear cover is provided about the blanket cylinder gear and is designed to resiliently sealingly engage the gear cover of the printing unit to which the coating apparatus is installed. When the coating unit is retracted, a cover is supplied to seal the cutout in the press gear cover. Therefore the integrity of the oil bath is maintained within the press gear cover in both operating and retracted positions of the apparatus.

A specific sequence of actuation of the transfer roll relative to the coating blanket cylinder, and actuation of the coating blanket cylinder (and, therefore, of the entire assembly) relative to the impression cylinder for proper coating operation, is specifically discussed later herein. This apparatus is well adapted to be built into a new printing press or to be retrofitted into existing equipment.

Other feathers and advantages of the invention will be apparent from the following description of the preferred embodiment.

SPECIFIC EMBODIMENTS OF THE INVENTION

Figure 1A:
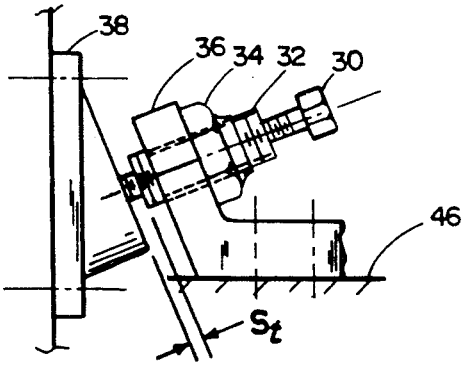
FIG. 1A is a side view of stop on the coating apparatus of FIG. 1.

This invention will be described with reference to the drawing in which like parts have been given like reference characters.

Figure 1:
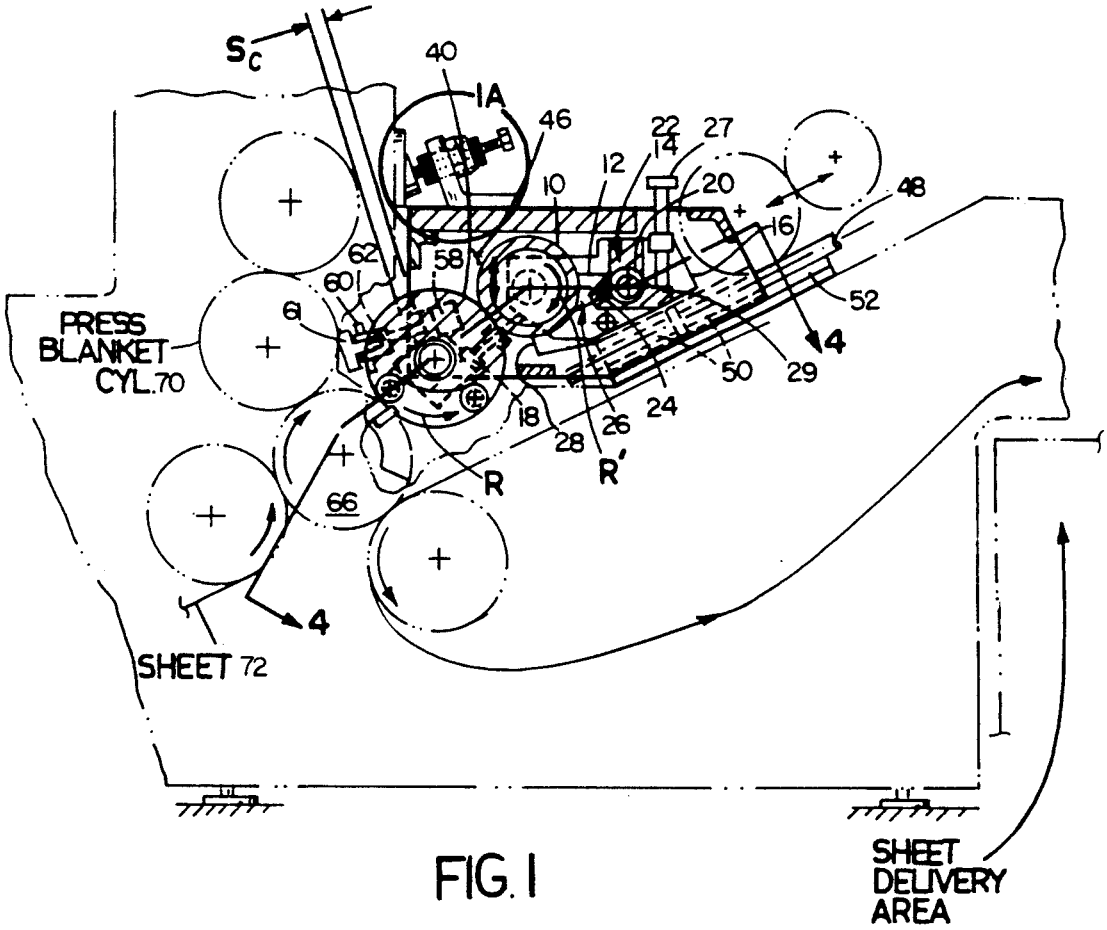
FIG. 1 is a side view of the coating apparatus including a diagrammatic view of a printing press with which it is operatively associated. In this Figure the cylinders of the coating assembly are shown in solid in their coating operating position and in phantom in their retracted position. The coating apparatus is shown in section.
Figure 4:
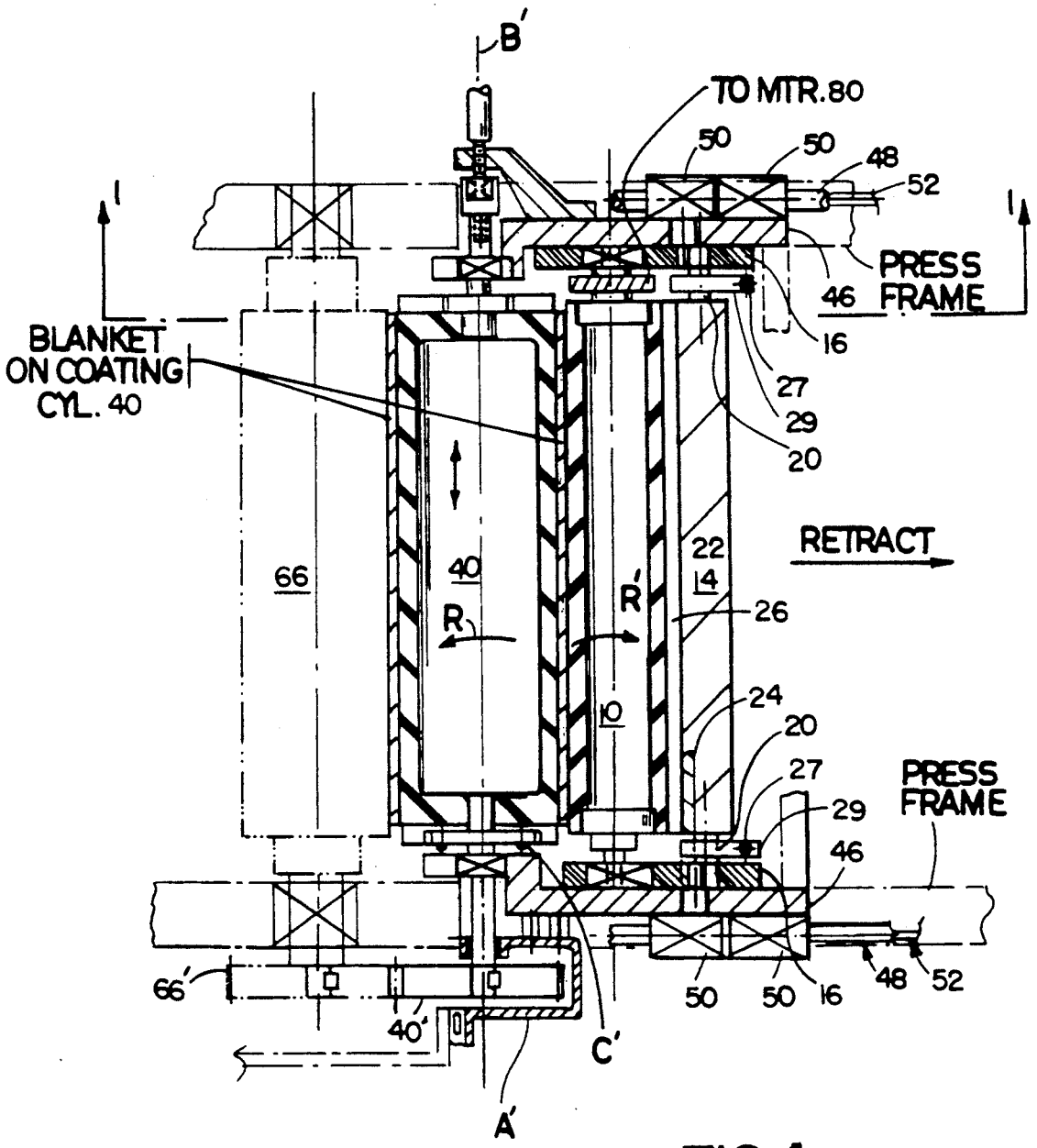
FIG. 4 is a cross-sectional view taken along lines 4—4 from FIG. 1.

Referring now to FIGS. 1 and 4, the coating apparatus assembly of this invention comprises a transfer roller 10, journalled for rotation, onto which is fed coating material 12, and a metering assembly 14 which is suitably adjustably mounted relative to the transfer roll to deliver a predetermined quantity of liquid coating, substantially evenly along the surface of the transfer roller 10. This metering assembly 14 includes a rotatably mounted journal 20 which is generally parallel to the axis of the coating transfer roller 10. Mounted substantially centrally about the journal 20 is a housing 22 from which a blade clamp 24 extends. A doctor blade 26 is positioned in the blade clamp 24 and is angularly positioned against the transfer roller 10. The doctor blade 26 is suitably made of blue spring steel, suitably about ten thousandths of an inch thick, and suitably extends out of the clamp 24 about one half inch. The angular position of the blade 26 may be about 40° to a tangent to the transfer roller surface. It has been found to be useful to force the doctor blade 26 against the transfer roller 10 with a pressure of about one half to one pound per linear inch. The transfer roll (with the metering device) is mounted at each end thereof in a common frame 16 which is in turn rotatably supported in a coater assembly housing 46. Frame 16 is pivotally rotated, or otherwise moved, by cylinder 57, not shown, to adjustably engage transfer roll 10 to a lightweight (e.g., aluminum) coating blanket cylinder 40 for proper coating application. Movement of frame 16 does not affect pressure between roller 10 and blade 26. Likewise, movement of housing 46 does not affect the pressure setting, or the relative positions, of transfer roll 10 and coating blanket cylinder 40. Adjustable stop 18 is provided to set a light "kiss" pressure between roller 10 and cylinder 40.

A drip pan 28 having an outlet is provided, and is positioned below the transfer roller 10 and the metering assembly 14. The pressure exerted by the doctor blade 26 against the transfer roller 10 can be adjusted by means of two adjustment screws 27 which extend to corresponding adjustment brackets 29 clamped on the axle 20. It is preferred that the adjustment screws are attached to the brackets off center with respect to the axis of the axle 20 so that the rotation of these adjustment screws will pivot the axle 20 whereby changing the pressure of the doctor blade 26 on the roller 10. A cover may be provided over the coating 12 and roller 10.

A coating blanket cylinder 40 is provided in operative, takeoff contact with the transfer roller 10. The blanket roller has its own journals rotatably mounted, suitably in needle bearings, and supportingly attached to the same housing 46 as supports the common frame 16 for the transfer roller and metering assembly. This housing 46 is slidably mounted on rails 48 which, in a preferred embodiment of this invention, are inclined so as to easily move the coating assembly into and out of the line as well as provide a guide for adjustment and actuation of the coating blanket cylinder (and entire unit) relative to the impression cylinder of the press.

Specifically, the housing 46 is mounted on bearing blocks 50 that are in turn slidably mounted on the two parallel rails 48. The rails 48 are mounted on rail supports 52 which are adapted to be directly connected to the press unit.

Hydraulic cylinders 58 each with an adjustable clevis 62 are mounted on opposite sides of the housing 46 to provide proper actuation and a "kiss" pressure contact between the coating blanket on the special blanket cylinder 40 and the sheet on press impression cylinder 66. Suitably a latch 60 is provided to insure positive positioning and lock-up of the entire coating assembly with relation to the printing unit, i.e., the coating blanket cylinder 40 with the impression roller 66.

Double adjusting screws 30 and 32 are supported by support 36 attached to housing 46. Screw 30 bears against stop block 38, attached to the press frame. Screw 32 is locked by nut 34. Rotation of screw 30 provides for paper pressure adjustment and thickness changes in sheet stock, while setting screw 32 provides a safety such that gears mounted on the coating blanket cylinder and press impression cylinder, cannot be meshed beyond a preset point while in the coating mode of operation. Once nut 34 is tightened, the nut is fixed (as if it were welded or pinned) for a specific screw 32 setting. Clearance "$S_c$" in FIG. 1 depends on the thickness of the sheet, $S_t$ which is generally between 0.000 to 0.030 inches. As shown in FIG. 1, clevis 62 is adjusted such that a clearance exists within cylinder 58, between the piston and cylinder wall. The piston serves as an "OFF" stop for the coating assembly when the assembly is actuated. A separation will therefore exist between the blanket and sheet when in the "OFF" impression position. For a theoretical 0.000 sheet thickness, $S_c$ should be set for 0.060 inches approximately.

A gear-motor 80, which may be hydraulic or electric, is suitably provided to drive the transfer roll 10. Suitable means is provided to retract the coating assembly into and out of operative relation with the impression roller 66, up and down the rails 48.

The coating assembly is shown in cooperative relationship with a conventional series of printing rollers. The coating blanket on blanket cylinder 40 is in light "kiss" contact with the sheet on impression cylinder 66, the sheet on the impression cylinder being also in contact with a printing blanket on blanket cylinder 70; impression cylinder 66 thereby serves as a dual impression cylinder, first for printing and next for coating. The sheet work piece is shown at 72.

The coater is first locked into operation on the press unit by lowering it along the rails 48 toward the press unit and engaging clevis 62 to lug 61 mounted on the press through releasable latch pin 60. In operation, gearmotor 80 mounted on housing 46 rotates the roller 10 as coating fluid is pumped under pressure from a fluid reservoir (not shown) to an inlet opening in the doctor blade assembly. From there, coating spreads over the surface of roller 10 and is distributed by the doctor blade 26. A continuous flow of coating is maintained over the surface of the roller 10 and excess coating is recovered through drip pan 28, with an outlet for recycling. In this way, sufficient flow is maintained to provide a flooded nip of coating between roller 10 and blade 26 and to provide uniformity of coating along the rollers' length. The amount of coating carried by the transfer roller 10 can be adjusted somewhat by turning screws 27 to adjust the pressure between doctor blade 26 (or a metering roller) and the transfer roller 10, as described above. Hydraulic cylinders 58 serve to pull the entire unit against the press with a force that can be adjusted by adjusting the pressure in the cylinders 58. Screw 30 adjusts "ON" pressure between the coating blanket on blanket cylinder 40 and a sheet carried on impression cylinder 66. Cylinders 58 further serve to separate the coating blanket cylinder from the impression cylinder while gears mounted on the adjacent cylinders still remain in mesh. Separation or clearance "$S_c$" in FIG. 1 is about 0.060 to 0.030 inches to provide an "OFF" condition of the coater assembly to stop application of coating. As the blanket cylinder 40 rotates in direction R, coating is applied to the just printed sheet. Transfer roller 10 rotates as shown by direction R'.

A uniform amount of liquid coating is continuously transferred to the blanket roller 40 at the nip between the blanket roller 40 and the transfer roller 10. The blanket roller 40 in turn delivers that coating to the workpiece as the workpiece travels through the nip between the blanket roller 40 and the impression roller 66. Changing the speed of roller 10 results in a change of coat weight added to the sheet.

When the coater is not in use, latch pin 60 is released, and a suitable means moves the coating unit back along the rails 48 away from the printing rollers.

More specifically, when using an acrylic water-based coating, a suitable transfer roller may be a quadrangular cell cylinder, having about 140 lines/inch, each square inch of cells carry 15 cubic billion microns of coating. A suitably engraved roller is sold by Pararco Roller Co. of Dallas, Tex. (Exact roll cell nomenclature is: 140 Rotoflo/138 for an optimum roll surface structure.) An acrylic water-based coating having about 45% solids can be applied to achieve an optimum dry coat weight of ~0.4–0.6 pounds per 1000 square feet, using a roll surface speed of 1:1 with that of coating blanket roll 40.

Figure 2:
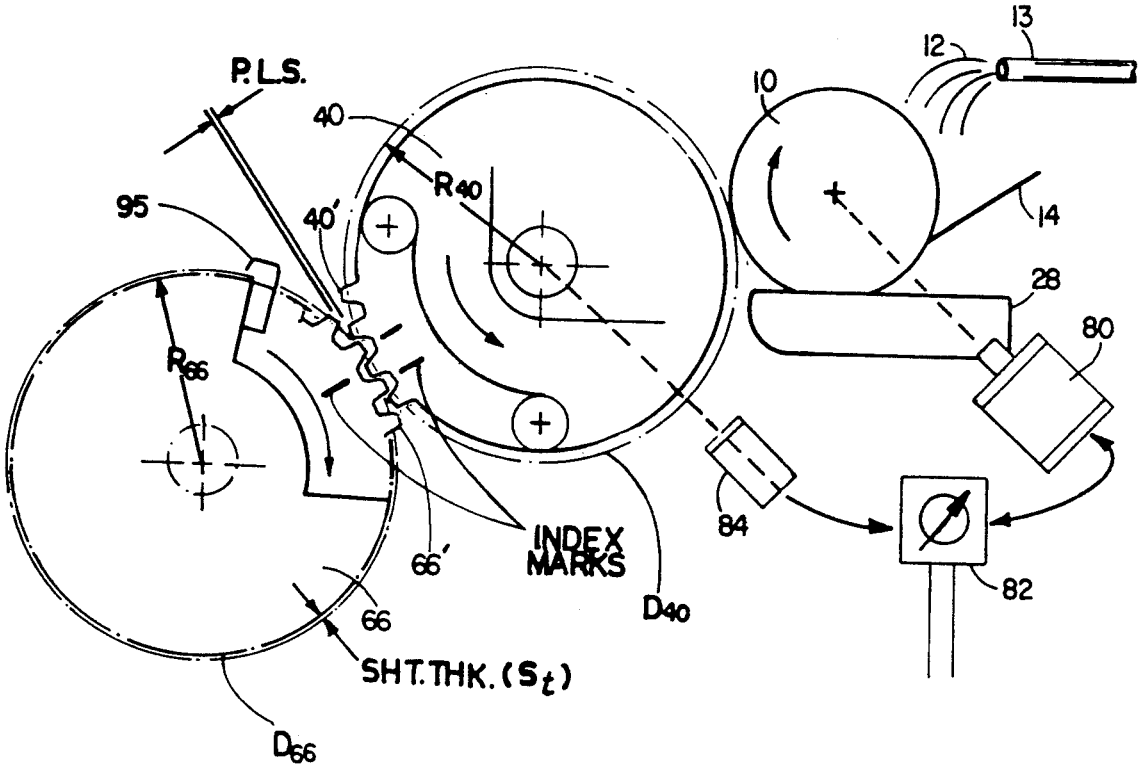
FIG. 2 is a diagrammatic side view of a set of coating application rollers showing details of controls for positively, drivingly, linking these rollers to a printing system.

Referring now to FIG. 2, there is shown a portion of a coating apparatus assembly including transfer roller 10, coating material 12 fed from a supply thereof 13 and metered onto the roller by means of a doctor blade assembly 14, including a drip pan 28. The transfer roller 10 is suitably driven by direct drive gear motor 80 whose speed is controlled by a controller 82 responding to sensor 84 which senses the speed of the coating blanket cylinder 40. Controller 82 is adjusted to provide a preset surface speed ratio, 1:1 or less, between roller 10 and cylinder 40, the slowest surface being that of roller 10. Impression cylinder 66 includes a sheet gripper 95. The coating blanket on blanket cylinder 40, and associated drive gear 40', preferably have the same operative diameter as the impression cylinder 66 and press gear 66'. Gear 40' is directly driven by press gear 66' of cylinder 66 so as to insure a positive synchronized drive relation there between. In FIG. 2, no worksheet is shown in this figure for clarity. Index marks are placed on adjacent gears to insure proper register of adjacent cylinders. The gear pitch line separation "P.L.S." is approximately equal to the sheet thickness "Sht.Thk.", $S_t$, shown on cylinder 66. $D_{40}$ is a broken line corresponding to the outer diameter of the blanket on cylinder 40, and the pitch line of gear 40' and $D_{66}$ is a broken line corresponding to the outer diameter of impression cylinder 66 and the pitch line of gear 66'. $R_{40}$ is equal to $R_{66}$ and thus $D_{40}$ and $D_{66}$ are equal.

Figure 3:
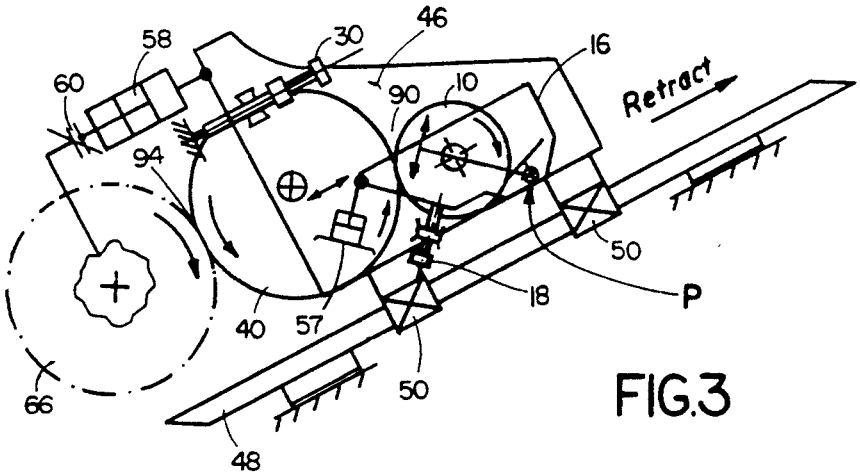
FIG. 3 is similar to FIG. 2 showing a schematic view of controls for the coating apparatus hereof for adjustment, actuation and retraction of the coating assembly relative to the press, actuation and adjustment of the transfer roll relative to the coating blanket cylinder and the metering means relative to the transfer roll.

Referring now to FIG. 3 which is similar to FIG. 2, there is shown the same three rollers, the transfer roller 10, the coating blanket cylinder 40 and the dual, common, impression roller 66. The transfer roller 10 and the coating blanket roll 40 are shown commonly mounted in assembly 46 via bearing blocks 50, on inclined rails 48. There is shown in this figure a first cylinder 57 with stop 18 which adjusts the pressure in the nip 90 between the transfer roller 10 and the coating blanket on blanket cylinder 40. A second cylinder 58 and screw 30 are provided to control the spacing in the nip 94 between the coating blanket on the blanket cylinder 40 and the dual impression cylinder 66 to accommodate a particular sheet thickness. The last color printing blanket roll 70 is not shown for clarity. Frame 16 pivots at P in FIG. 3.

FIG. 4 is a sectional view taken along lines 4—4 of FIG. 1 showing relationship or roll lengths to each other, a cover A' about the coating blanket cylinder drive gear, lateral and circumferential register provisions for the coating blanket cylinder, B' and C' respectively and other component parts shown in FIG. 1.

As best shown in FIG. 4, housing 46 is offset to the inside of the press frame in the area of the bearings for coating cylinder 40, and therefore clears the press frame in this area. The remainder of the housing may lie along the inclined surface of the frame; that is, directly above the frame. This offsetting of housing 46 prevents having to alter (cut away) a portion of the press frame adjacent the bearing.

For sequencing of rolls for proper coating operation, the following procedure is followed:

| | |
|---|---|
| "ON" | 1. Transfer roll actuates to coating blanket cylinder upon actuation of press blanket cylinder of last printing unit. |
| | 2. Coating blanket cylinder actuates to sheet on press impression cylinder upon one full revolution of press. |
| "OFF" | 1. Transfer roll separates from coating blanket cylinder upon actuation of blanket cylinder of preceding press unit. |
| | 2. Coating blanket cylinder separates from the sheet on the press impression cylinder upon actuation of the press blanket cylinder of the last printing unit. |

Figure 5:
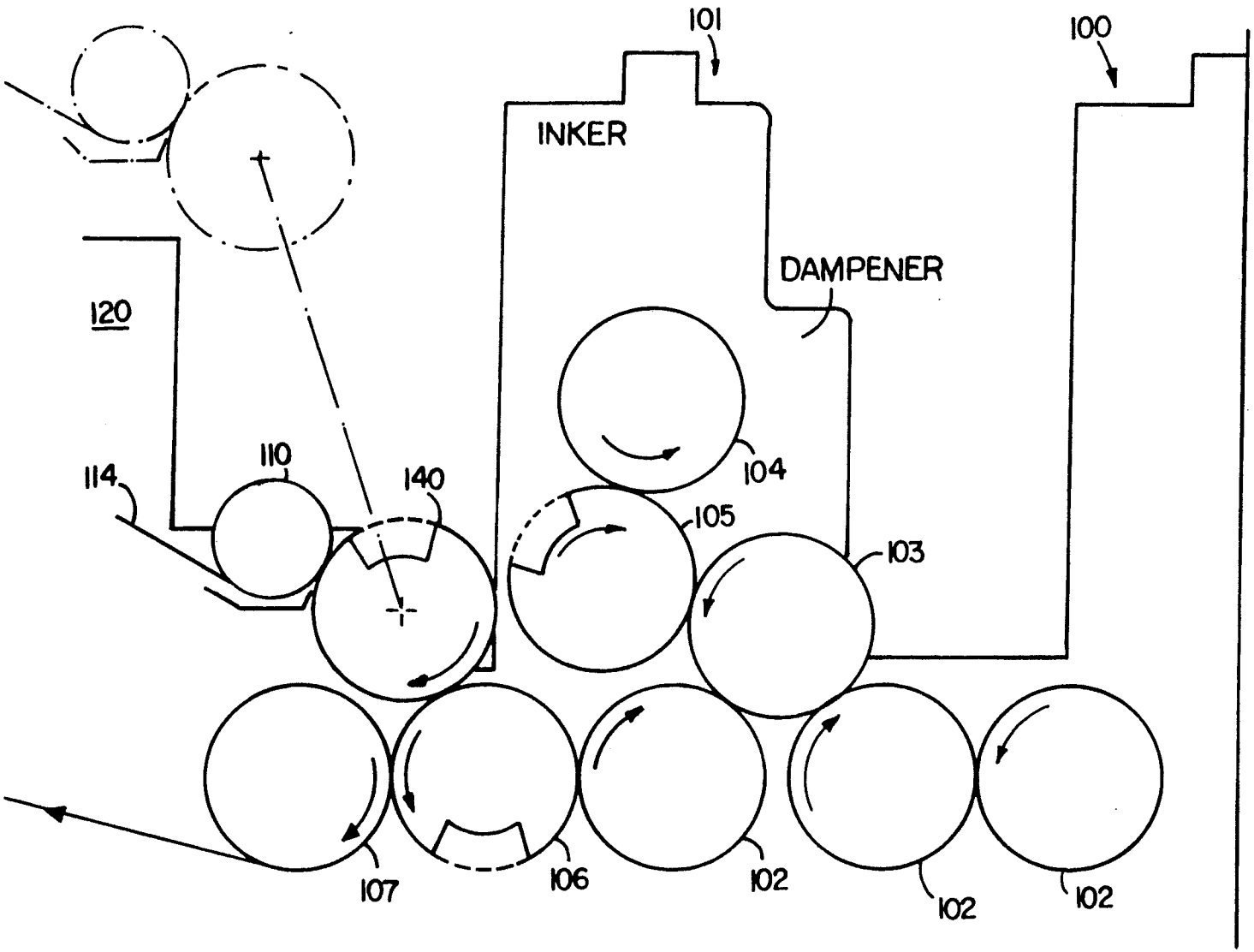
FIGS. 5 and 6 are diagrammatic representations of two alternative embodiments of the invention, respectively, in which the coating assembly is engaged with an impression cylinder retrofit in place of a transfer cylinder.

An alternate embodiment is shown in FIG. 5, which is particularly applicable for press units which cannot accommodate a coating assembly according to the invention in operable association with the press unit blanket cylinder as described above. In FIG. 5, an impression cylinder is installed downstream of the final press unit, in place of a sheet transfer cylinder which ordinarily transfers the workpiece along a path from the final unit to the press delivery.

Specifically, press units 100 and 101 generally correspond to the Miehle Super 60" press. The positioning of certain cylinders in that press does not permit installation of a coating assembly as described in the embodiment of FIG. 1. Existing press unit 101 includes sheet transfer cylinders 102, an impression cylinder 103, and plate and blanket cylinders 104 and 105. Ordinarily, the cylinders at positions 106 and 107 are also sheet workpiece transfer cylinders to transfer the workpiece from the final unit 101 to the delivery area 120.

According to the invention, the sheet transfer cylinder ordinarily occupying position 106 is replaced by an impression cylinder which cooperates with a retractable coating assembly having a coating blanket cylinder 140 as described above. Other components of the coating assembly of FIG. 5 (e.g., transfer cylinder 110 and metering assembly 114) are the same as described above and require no further description. The operation of the apparatus of FIG. 5 is analogous to the operation of the above-described apparatus of FIGS. 1–4, and the coated sheet is transported to the press delivery.

Figure 6:
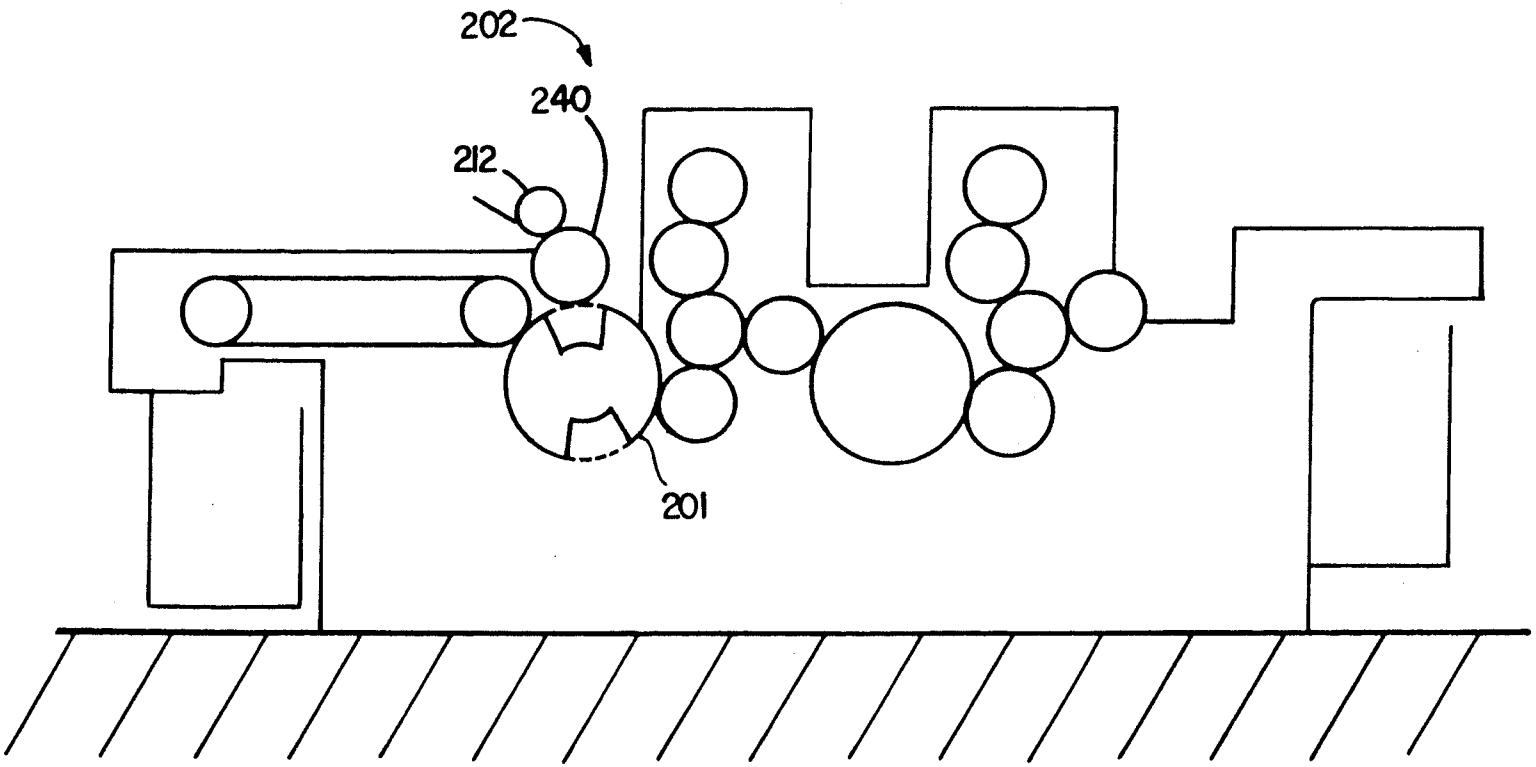

FIG. 6 shows a similar arrangement for a small (25") Heidleberg MO® press, in which a double-size sheet transfer cylinder at position 201 has been replaced with a double-size impression cylinder. A retractable coating assembly 202 according to the invention is positioned in operative association with the impression cylinder at 201. Coating assembly 202 includes a coating blanket cylinder 240 and a coating transfer cylinder 210.

Figure 7:
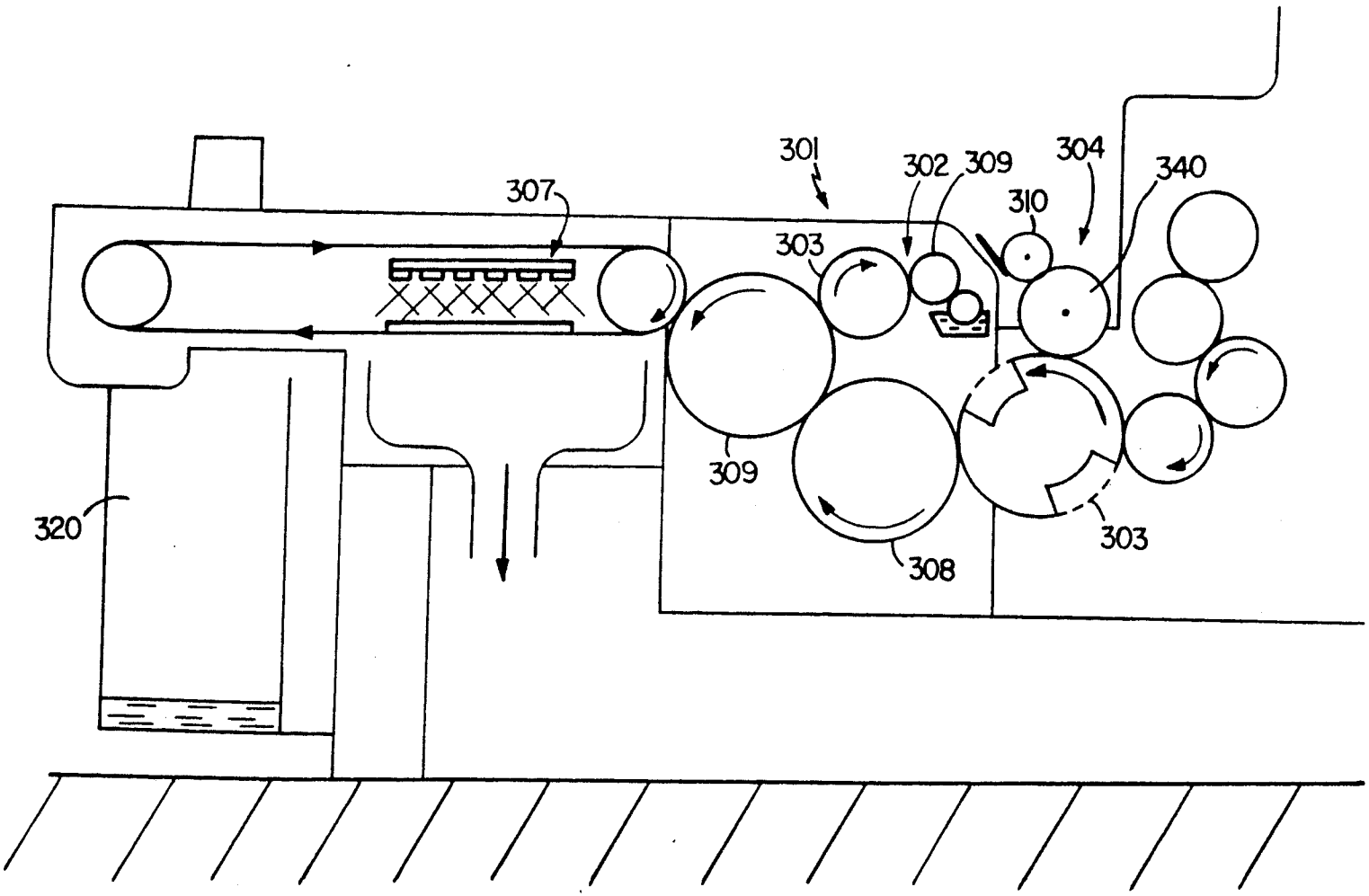
FIGS. 7 and 8 are diagrammatic representations of yet two additional embodiments of the invention, respectively, in which the blanket coater of the invention is employed with a coating tower on either an impression cylinder retrofit at a transfer cylinder of the last press unit, or directly on the impression cylinder of the coating tower.

FIG. 7 shows an arrangement featuring the use of a coater on a press that includes a Heidleberg coating tower 301 downstream from the final press unit. The coating tower includes a standard coating unit 302, having an application cylinder 303 which applies coating to a workpiece nipped between application cylinder 303 and coating impression cylinder 309 for applying a coating. A retractable coating assembly 304 according to the invention can be added by replacing the transfer cylinder at position 303 with an impression cylinder, and adding the coating assembly 304 upstream from the standard unit 302. Coating assembly 304 includes a retractable blanket cylinder 340 and a coating transfer cylinder 310, each of which is substantially similar to the coating cylinders described in FIGS. 1–4. The workpiece is transferred via transfer cylinder 308 to coater 301. In this way, it is possible to apply a water-based pre-coat to the sheet workpiece at unit 304, upstream from the application of a U.V. sensitive coating at standard unit 302. The precoating is dried before the U.V. coating is cured at station 307. After coating, the sheet is presented to the press delivery 320 in the standard way. Such a double coating system is particularly useful where the ink and the U.V. coating are not compatible, requiring the intermediate pre-coating layer to separate them.

Figure 8:
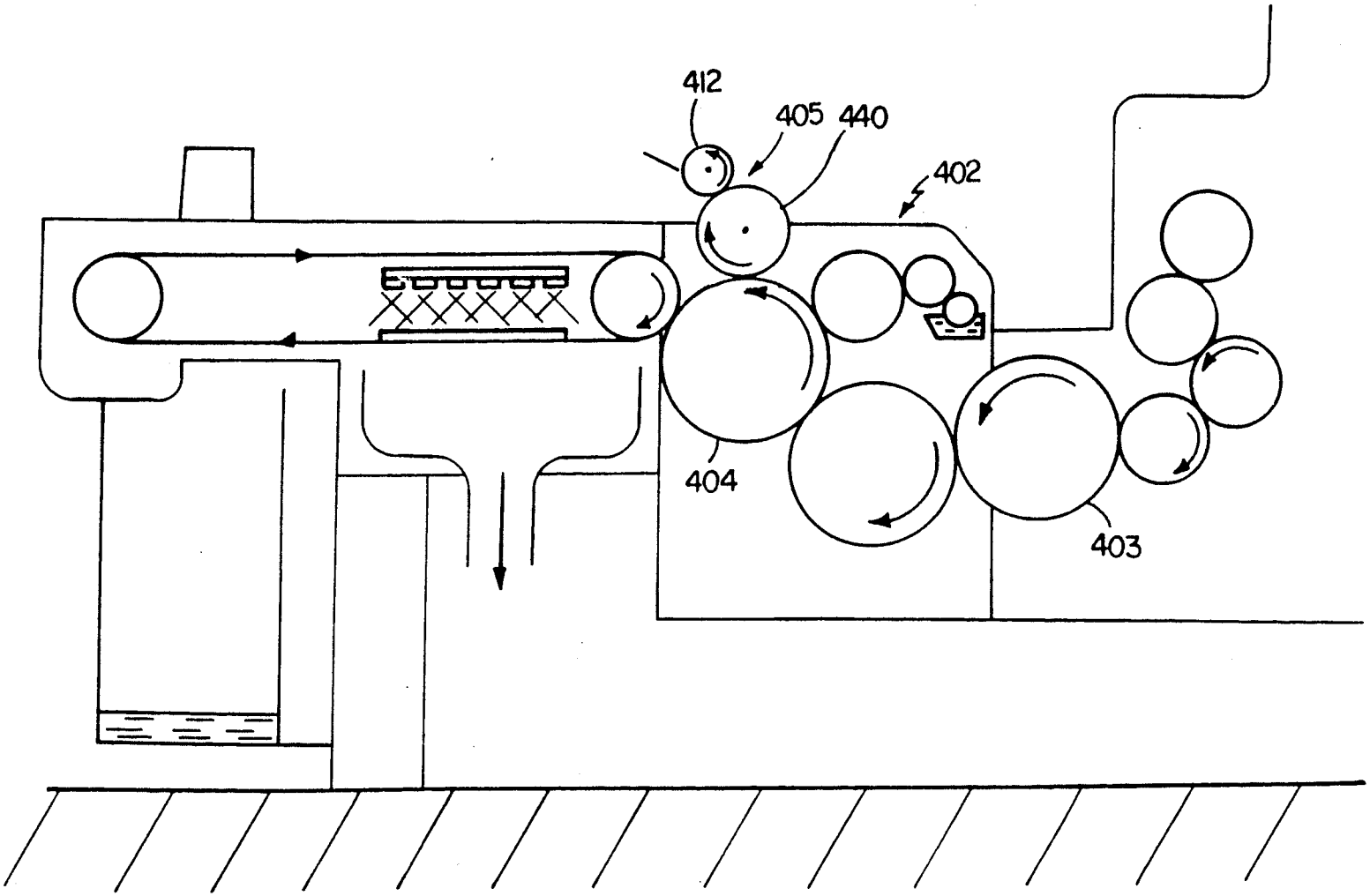

FIG. 8 shows an alternative retrofit of the coating tower shown in FIG. 7. Specifically, the cylinder in position 403 is a standard transfer cylinder. Coating impression cylinder 404, which is part of the standard coating unit 402 serves to apply a second layer of coating from the coating assembly 405 according to the invention, which is retrofit to work in cooperation with impression cylinder 404. Coating assembly 405 includes a blanket cylinder 440 and a transfer cylinder 410 as described above. The remainder of the coating tower and delivery is generally as described for FIG. 7, and further description is not necessary here. The embodiment of FIG. 8 is useful for applying a double layer of coating at a single impression cylinder, with the first layer being applied by the standard coating unit 402 and the second layer being applied as described above.

Figure 9:
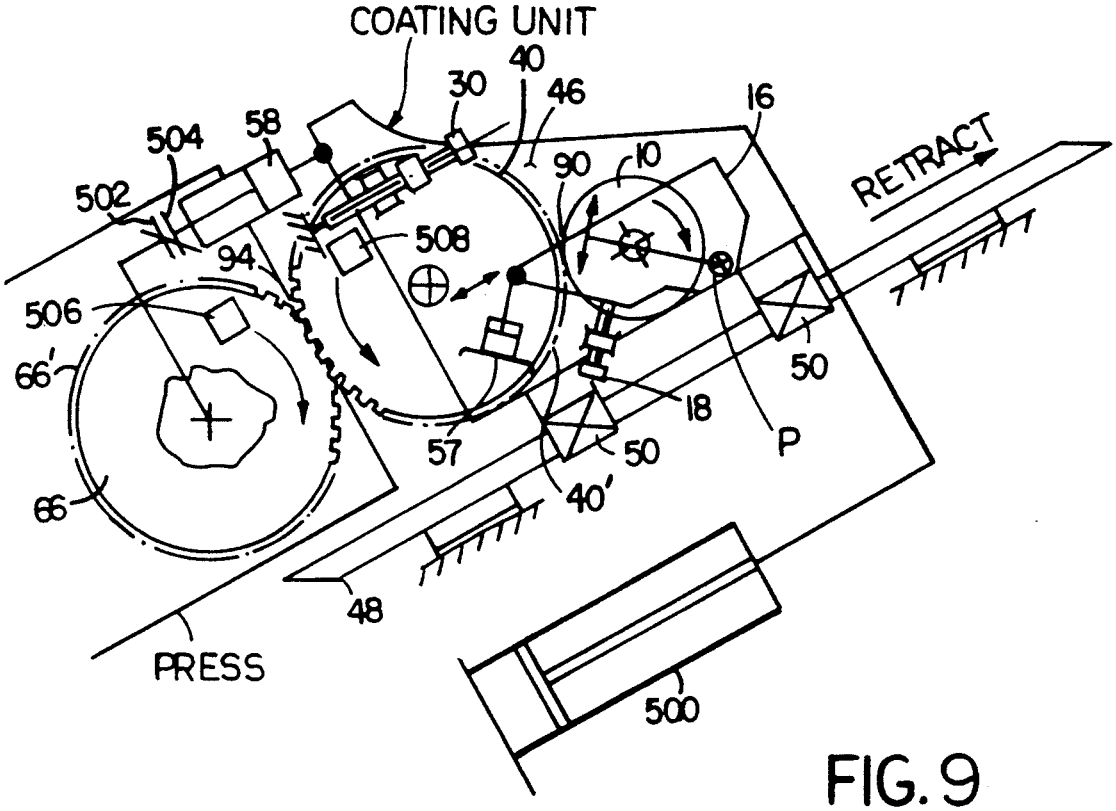
FIG. 9 is diagrammatic illustration of the means of locking the blanket coating cylinder to the press impression cylinder.
Figure 10:
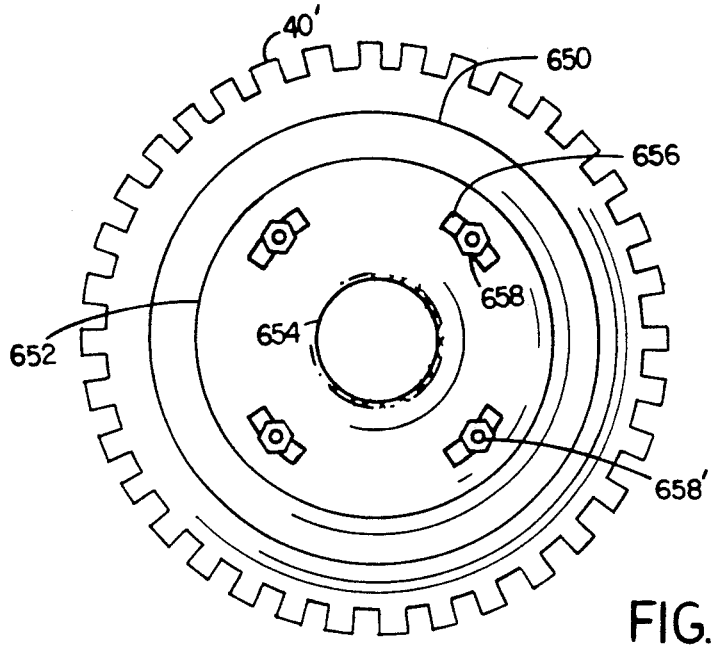
FIG. 10 is a diagrammatic illustration of the means of circumferential register adjustment.
Figure 11:
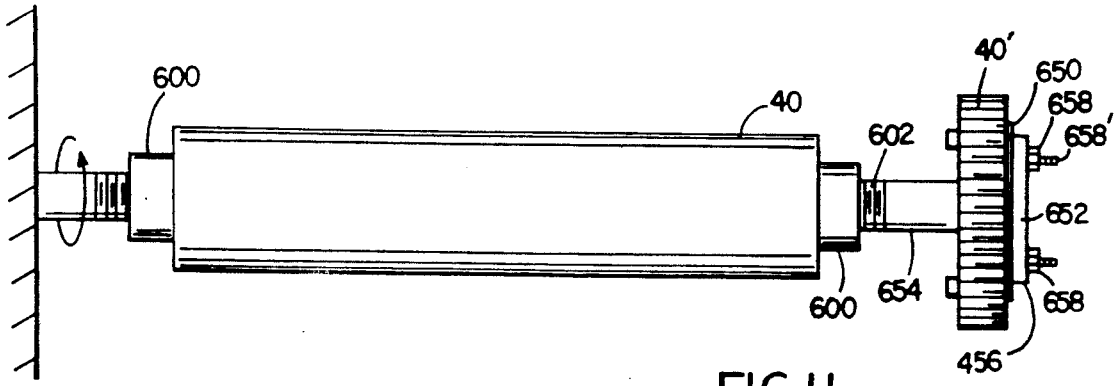
FIG. 11 is a diagrammatic illustration of the means of lateral register adjustment.

Another alternate embodiment is shown in FIGS. 9–11 which includes alternative features of the coating unit embodiment illustrated in FIGS. 1–4.

A different method of "locking" the coating unit (e.g. the unit of FIG. 3) to the press is illustrated in FIG. 9. The coating unit is displaced down the rails 48 by means of a hydraulic cylinder 500. Once in the vicinity of the press, electromagnets 502, 504, located on the press and the coating unit, respectively, mate and attach the coating unit to the press. These electromagnets act to maintain the relative positions of the two units and therefore serve to replace latch pin 60, lug 61, and clevis 62.

Before attaching the coating unit, a registering process is initiated. Registering refers to aligning the coating unit with the press in an operative position. More specifically, registering aligns the teeth of gear 66' attached to the press impression cylinder 66 to those of another gear 40' attached to the coating blanket cylinder 40. Additionally, when the gears have been properly aligned, the sheet gripper is in its proper position relative to (and is registered with) the blanket gripper and gap on cylinder 40. Proximity sensors 506, 508 (or their equivalent) are attached to gear 66' and gear 40', respectively, and are placed near the perimeter of the gears. Both gears 66', 40' are rotated relative to one another until these sensors 506, 508 are in their nearest proximity, indicating proper orientation. The gear teeth are then brought together in a mesh configuration, and index marks of FIG. 2 will be as shown.

Gear 40', attached to the coating blanket cylinder, is made of a resilient plastic material (i.e. MC901 Nylon). The purpose of manufacturing the gear out of plastic is to avoid problems associated with uneven gear wear. Metal gears in a gear train that have differencing amounts of wear may not mesh properly and may cause poor quality printing. Therefore, all metal gears in a gear train are usually replaced concurrently so that wear is matched for all gears in a set. A plastic gear on the retrofit blanket cylinder can adjust to the wear of the press gear 66' because of its ductile and resilient qualities. Therefore, coating unit gear 40' can be maintained independently of press gear 66' and can be retrofitted or replaced independent of the state of wear of press gears without interfering with the quality of the printed material.

When the coating unit is locked to the press, it sometimes becomes necessary to realign the coated blanket cylinder 40 without separating the coating unit from the press. Therefore, both circumferential and lateral adjustments are possible.

Means for circumferential adjustments are illustrated in FIG. 10. The gear 40' attached to the coating blanket cylinder 40 includes a hub 650. Atop the hub 650 is a face plate 652 which is secured to the coating blanket cylinder shaft 654 (shown on end view). Four bolts 658', attached to the hub 650 extend out of the hub through four machined slots 656 in the face plate 652. Four nuts 658 are tightened on the bolts and are utilized to fasten the face plate 652 and shaft 654 to the gear hub 650, thereby fixing the rotational orientation of the coating blanket cylinder 40 to the gear 40'. To adjust the cylinder orientation with respect to the fixed gear position, the nuts 658 are loosened, and the face plate 656 and shaft 654 are rotated relative to the gear hub. Apparently, the limits of rotation are defined by the circumferential length of the machined slots 656.

Means for lateral adjustments are illustrated in FIG. 11. Coating blanket cylinder 40 is attached to a shaft 654 at both ends. Gear 40' is mounted on one end of this shaft 654 (as described above). The lateral position of the cylinder 40 is maintained via shaft collars 600. The shaft collars 600 are placed on opposite ends of the shaft, and when secured, do not allow for lateral motion of the cylinder with respect to the shaft. Cylinder 40 is preferably keyed to the sheet 654 to prevent circumferential movement of the cylinders relative to the shaft. These collars have internal threads, and the shaft hollow tubes having an inner diameter is threaded externally.

Each shaft collar 600 includes inner screw threads which mate with outer screw threads 602 contained on the shaft 654. To move the cylinder 40 in a lateral direction, shaft collars 600 are loosened on the cylinder which specifically entails rotating these collars on their threads away from the cylinder, to free the cylinder to be laterally displaced on the shaft in either direction. When a desired position is achieved, the cylinder 40 is again tightened to the shaft 654 by rotating the shaft collars 600 on their threads toward the cylinder and into a tight fit against the cylinder. The force of the shaft collars against the cylinder act to lock the cylinder in a fixed lateral orientation relative to the shaft.

Figure 12A:
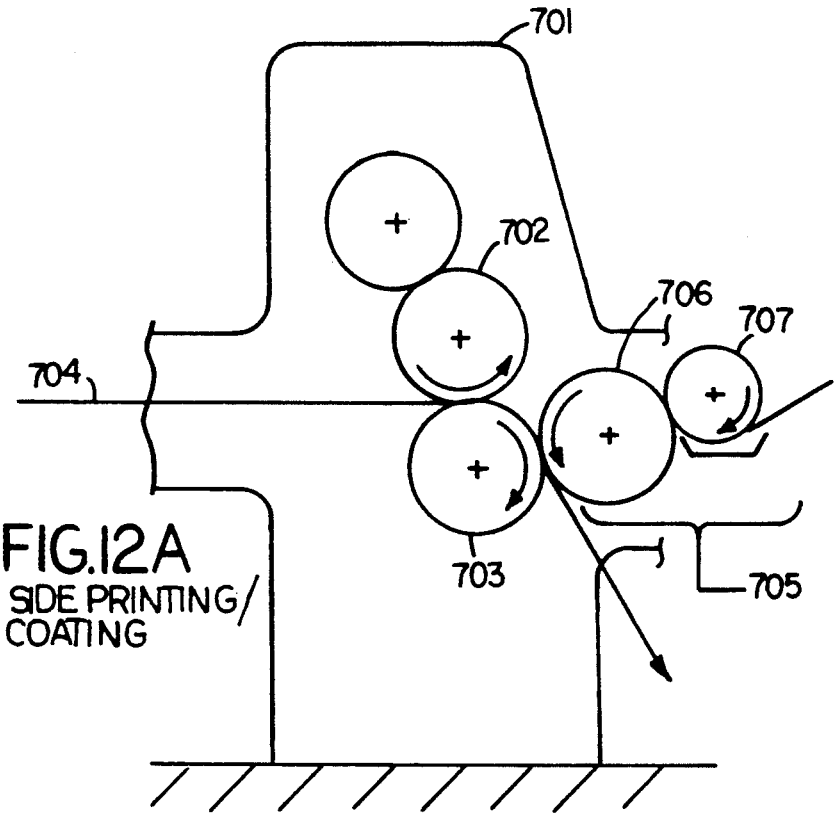
FIGS. 12*a* and 12*b* respectively show the coating assembly adapted to single-sided, and to two-sided, web printing applications.
Figure 12B:
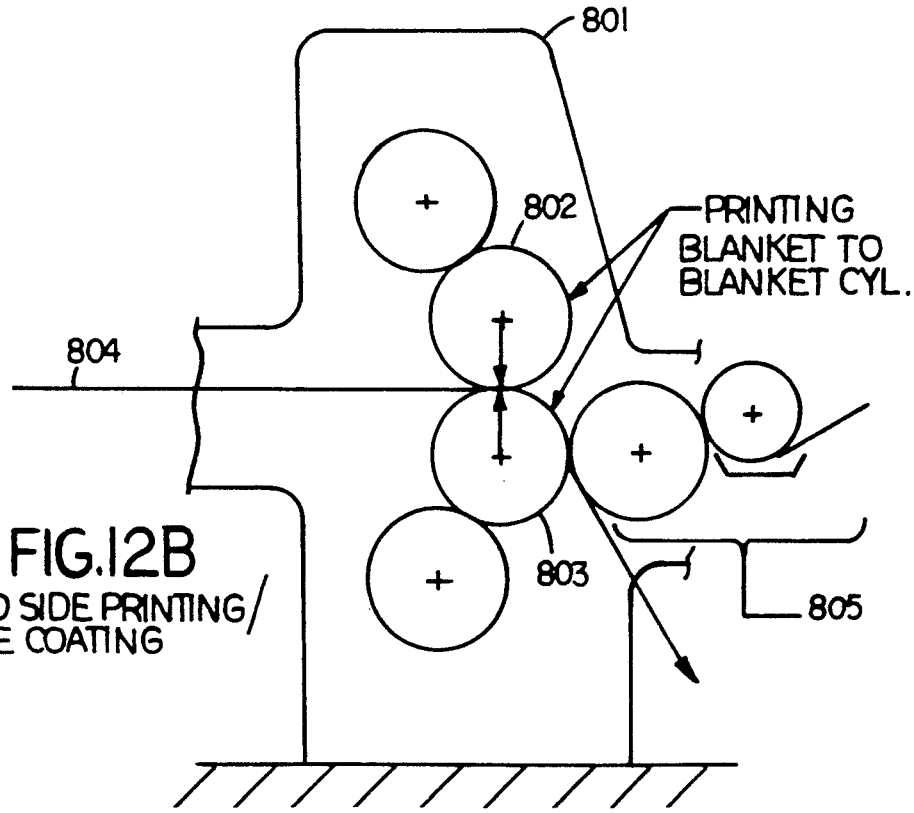

FIGS. 12*a* and 12*b* show the coating unit adapted for two different web offset presses to coat, e.g. with a U.V. coating). In FIG. 12*a*, press unit 701 is a single-sided web offset lithographic press, having a printing blanket cylinder 702 and an impression cylinder 703 for printing web workpiece 704. Coating unit 705 includes metering cylinder 706 and blanket cylinder 707, as described above.

In FIG. 12*b*, press unit 801 is a double sided (blanket-to-blanket) web offset lithographic press unit in which blanket cylinders 802 and 803 print opposite sides of web workpiece 804 simultaneously. Coating unit 805 operates in associating with blanket cylinder 803 to coat the top side of web 804.

OTHER EMBODIMENTS

Other embodiments are within the following claims. For example, other doctor blade arrangements may be used to doctor the coating from the transfer roller 10, such as a system utilizing a reverse angle blade or having dual blades and having a coating inlet between the two blades. A roll, or roller means, may also replace the doctor blade arrangement. Other types of engraved or smooth surfaced cylinders may be used. Those skilled in the art will appreciate that the coating unit described above may be adapted to achieve numbering, slitting, scoring, and the like. Moreover, the coating unit described above may be used to deliver varnishes, coatings, glues, dyes, etc. in addition to coatings. Other types of presses may be used in conjunction with the coater, but offset lithographic sheet-feeding presses are preferred. For example, the coating unit may be adapted to web offset press printing.

What is claimed is:

1. A coating apparatus for applying a liquid coating to a workpiece in co-operation with an impression cylinder mounted on a lithographic printing press, said press having at least one ink carrying surface for applying ink to said workpiece prior to coating, said coating apparatus comprising, a) an independent, cooperatively operating coating assembly comprising:
   i) a liquid coating supply means;
   ii) a coating carrier which includes a resilient coating carrying surface for carrying liquid coating;
   iii) a means for metering and transferring liquid coating, operatively connected between said coating supply and said carrying surface, for maintaining a controlled amount of liquid coating on said coating carrying surface; and
   iv) structural members integrating said means for metering and transferring liquid coating and said coating carrier into said coating assembly;

b) supports for allowing movement of said coating assembly between: i) an operative position in which said coating surface on said carrying surface is in rotative pressure contact with a workpiece on said press unit impression cylinder; and ii) a fully retracted position in which said coating assembly is completely disengaged from said press unit impression cylinder at a location remote from the press unit impression cylinder, said coating assembly, including said coating carrier and said means for metering and transferring coating material, remaining connected during said movement;

whereby, in said operative position, said carrying surface continuously delivers a smooth, uniform, metered amount of said liquid coating material to said workpiece on said impression cylinder.

2. The coating apparatus of claim 1 in which said coating assembly comprises:

a) a roller means for metering and transferring a uniform predetermined quantity of coating to said resilient carrying surface on said coating carrier, said coating supply means being operatively associated with said roller means;

b) a movable support for said coating carrier, for moving said coating carrier into and out of contact with said workpiece on said impression cylinder;

c) a movable support for said roller means for moving said roller means into and out of contact with said coating surface on said coating carrier;

d) means for integrating said coating carrier and said roller means into said coating assembly;

e) means for independently actuating said coating carrier movement and said roller means movement;

f) means for independently adjusting pressure between said coating surface on said coating carrier and said workpiece on said impression cylinder and pressure between said roller means and said coating surface on said coating carrier; and g) means for integrating said coating assembly with said impression cylinder in said operative position, such that a change in pressure between said carrying surface on said coating carrier and said workpiece on said impression cylinder, or actuation of said carrier into and out of contact with said workpiece, does not alter pressure between said roller and said coating carrier; and such that a change in pressure between said roller means and said carrying surface on said coating carrier, or actuation of said roller means into and out of contact with said coating surface on said coating carrier, does not alter pressure between said coating surface on said coating carrier and said workpiece on said impression cylinder.

3. The coating apparatus of claim 1 in which said coating assembly comprises:

a) support and retraction means for said coating assembly allowing movement of said coating assembly between at least three positions, a first position in which said coating surface on said coating carrier is operatively engaged with a workpiece on said press unit impression cylinder, a second (off-impression) position in which said coating surface on said coating carrier is separated somewhat from said workpiece on said press unit impression cylinder, and a third (storage) position in which said coating assembly is removed away from the impression cylinder, allowing access to said press; said coating assembly, including said means for metering and transferring coating material, remaining connected during movement of said coating carrier as part of said coating assembly.

4. The apparatus of claim 1, claim 2, or claim 3 wherein said impression cylinder is operatively associated with a printing blanket cylinder positioned in a printing unit of said printing press, whereby, in operation, a workpiece on said impression cylinder contacts said printing blanket at a first workpiece location while it contacts said coating surface on said coating carrier at a second workpiece location, enabling simultaneous printing and coating at said impression cylinder.

5. The apparatus of claim 1 wherein said coating assembly is mounted on an inclined support.

6. The apparatus of claim 1 further comprising a means for moving the coating assembly toward or away from the press unit.

7. The apparatus of claim 6 wherein the means for moving the coating assembly comprises a hydraulic cylinder.

8. The apparatus of claim 1 wherein said means for metering and transferring coating comprises a transfer cylinder in operative contact with said coating surface on said coating carrier and means for metering the amount of coating carried on said transfer cylinder.

9. The apparatus of claim 8 including means to control the nip between said transfer cylinder and said coating surface on said coating carrier.

10. The apparatus of claim 1 including a gear positively coupling said coating carrier to said impression cylinder when said coating assembly is in said first operating position.

11. The apparatus of claim 10 wherein said gear comprises a plastic material.

12. The apparatus of claim 1 wherein the impression cylinder comprises a gear adapted to drive a gear for the coating carrier.

13. The apparatus of claim 10 further comprising means of registering the gear for the coating carrier with the adjacent impression cylinder gear.

14. The apparatus of claim 13 further comprising sensors on said coating carrier gear and said impression cylinder gear to rotationally align said gears with one another.

15. The apparatus of claim 1 further comprising means for adjusting the position of the coating carrier relative to the impression cylinder, while the coating carrier remains drivingly engaged with the impression cylinder.

16. The apparatus of claim 8 or 9 comprising an adjustable stop to control the nip between the coating surface on said coating carrier and the workpiece on said impression cylinder, without changing the coating carrier relationship to the liquid coating metering and transfer means.

17. The apparatus of claim 1 wherein said coating carrier further comprises means for register adjustment with the adjacent press impression cylinder.

18. The apparatus of claim 17 wherein the register adjustment comprises a plurality of bolts corresponding to slots, which cooperate to allow for movement of the coating carrier with respect to a gear for the coating carrier.

19. The apparatus of claim 17 wherein the coating carrier further has means enabling lateral register adjustment relative to the adjacent press impression cylinder.

20. The apparatus of claim 19 wherein the lateral register adjustment means comprises threaded collars adapted to allow for lateral movement of the coating carrier located at both ends of said coating carrier relative to a shaft extending through and supporting the carrier, said shaft being fixed against lateral movement.

21. The apparatus of claim 1 wherein said impression cylinder is retrofit into a position in said printing press ordinarily occupied by a workpiece transfer cylinder.

22. The apparatus of claim 21 in which said position of said impression cylinder is retrofit in place of a workpiece transfer cylinder positioned to transfer said workpiece to a fixed coater.

23. The apparatus of claim 1 wherein said printing press is connected to a fixed coater and said impression cylinder is an impression cylinder that forms part of said coater.

24. The apparatus of claim 1 further comprising a means of locking the coating assembly to the press unit.

25. The apparatus of claim 24 wherein the means of locking comprises a clevis and a press-mounted lug cooperatively sized and positioned to engage said clevis, and a releasable latch pin adapted to connect said clevis to said lug.

26. The apparatus of claim 24 wherein the means of locking comprises a pair of cooperatively sized and positioned electromagnets.

27. The apparatus of claim 2 comprising means to positively rotate said roller means, means to positively rotate said coating surface on said coating carrier in registration with said workpiece supported and conveyed on said impression cylinder, sequencing means, cooperatively associated with the means for actuating, for sequentially actuating movement of said roller to said coating surface on said coating carrier, before actuating movement of said coating surface on said coating carrier to engage said printed workpiece on said impression cylinder, and for sequentially actuating movement of said roller away from said coating surface on said coating carrier before actuating movement of said coating surface on said coating carrier away from said workpiece.

28. The apparatus of claim 1 comprising means to vary the surface speed of at least one roller in the roller means relative to the surface speed of the carrier.

29. The apparatus of claim 1, claim 2, or claim 3, wherein said coating carrier is a coating blanket cylinder or a coating plate cylinder.

30. The apparatus of claim 1, claim 2, or claim 3, wherein said coating carrier presents a gapped coating surface to said impression cylinder as said impression cylinder rotates, and said printing ink carrier presents a gapped printing surface to said impression cylinder as said impression cylinder rotates, said coating surface (including said gap therein) having a perimeter substantially equal to the perimeter of said printing surface (including said gap therein).

31. The apparatus of claim 1, claim 2 or claim 3 wherein the coating carrier is a coating plate cylinder carrying a plate.

32. The apparatus of claim 1, claim 2 or claim 3 wherein the impression cylinder is a standardly supplied impression cylinder supporting a workpiece being printed on a lithographic printing press unit.

33. The apparatus of claim 1, claim 2, or claim 3, wherein the impression cylinder is retrofit in place of a standardly supplied transfer cylinder on a lithographic printing press unit.

34. The apparatus of claim 2 wherein means supporting and integrating comprises a first pair of frames supporting said moveable support means for said carrier and said roller means, including said support actuating means and adjustment means, where said pair is minutely adjustable, actuatable and relocatable to a remote position from said impression cylinder, said impression cylinder being supported by a second pair of frames.

35. The apparatus of claim 34 wherein said actuation means for said first pair of frames include a pair of hydraulic cylinders.

36. The apparatus of claim 2 wherein said means for independently adjusting pressure includes stops and screws for adjusting pressure between said coating surface on said coating carrier and said workpiece on said impression cylinder, associated with means to limit pressure therebetween.

37. The apparatus of claim 2 wherein the roller means comprises an engraved anilox roll having an engraved cell structure with a maximum capacity of approximately 15 billion cubic microns per square inch for carrying a water-base acrylic coating having a solids content of approximately 45% to apply a dry coat weight to said sheet workpiece of approximately 0.4 to 0.6 lbs/1000 $Ft^2$ when the anilox roll has a surface speed approximating that of the resilient coating surface of the coating carrier.

38. Apparatus for applying a uniform and smooth liquid coating, on line, to a printed workpiece in a multicolor sheet-fed lithographic printing press wherein coating is applied to said workpiece while said workpiece is supported and conveyed by an impression cylinder of said press, said coating being applied over wet ink, said apparatus comprising:

a coating carrier supporting a resilient coating surface in rotative pressure contact with said printed sheet workpieces;

roller means for metering and transferring a uniform predetermined quantity of coating to said resilient coating surface on said coating carrier;

coating supply means operatively associated with said roller means;

means supporting said coating carrier, said roller means and said coating supply means, into a cooperatively operable coating assembly;

means to adjust pressure between said resilient surface on said coating carrier and said sheet workpiece;

means to adjust pressure between said roller means and said coating carrier;

means to rotate said coating carrier such that said resilient surface of said carrier rotates with said sheet workpiece to apply a uniform, smooth coating over wet ink on said sheet workpiece;

means to rotate said roller means;

means to actuate said coating carrier from said sheet workpiece to an off-impression position;

support and guide means for said coating assembly attached to said press;

and, means to retract said coating assembly including said coating carrier, said roller means and said coating supply means, to a remote position substantially away from said impression cylinder, to provide access to said press upon movement of said coating apparatus.

39. A method for printing and coating a workpiece, by transmitting said workpiece through a coating apparatus in cooperation with an impression cylinder mounted on a lithographic printing press, said coating apparatus comprising a) an independent, cooperatively operating coating assembly comprising:

i) a liquid coating supply means;

ii) a coating carrier which includes a resilient coating carrying surface for carrying liquid coating;

iii) a means for metering and transferring liquid coating, operatively connected between said coating supply and said carrying surface, for maintaining a controlled amount of liquid coating on said coating carrying surface; and iv) structural members integrating said means for metering and transferring liquid coating and said coating carrier into said coating assembly;

b) supports for allowing movement of said coating assembly between: i) an operative position in which said coating surface on said carrying surface is in rotative pressure contact with a workpiece on said impression cylinder; and ii) a fully retracted position in which said coating assembly is completely disengaged from said impression cylinder at a location remote from the impression cylinder, said coating assembly, including said coating carrier and said means for metering and transferring coating material, remaining connected during said movement;

whereby, in said operative position, said carrying surface continuously delivers a smooth, uniform, metered amount of said liquid coating material to said workpiece on said impression cylinder.

40. The method of claim 39 in which said impression cylinder is operatively associated both with a printing carrier at a first location on said workpiece and with said coating carrier at a second location on said workpiece, to simultaneously print and coat said workpiece at a single impression cylinder.

41. The method of claim 39 in which said printing press includes a coater for providing a U.V. curable coating, and said coating assembly coats with a precoat, prior to application of said U.V. curable coating by said coater.

42. The method of claim 39 in which said printing press includes a fixed coater comprising a fixed coater impression cylinder operatively connected to a coater blanket cylinder and to said coating assembly carrier, whereby said method comprises coating said workpiece with two coating layers at said fixed coater impression cylinder.

43. A method for applying a liquid coating to a workpiece, using a coating apparatus operating on line with an impression cylinder of a lithographic printing press, said press having at least one ink carrying surface for applying ink to said workpiece prior to coating. said coating apparatus comprising: a) a coating carrier adapted to carry a resilient coating surface in rotative pressure contact with said workpiece supported by said impression cylinder; b) a roller means for metering and transferring a uniform predetermined quantity of coating to said resilient coating surface on said coating carrier; c) coating supply means operatively associated with said roller means; d) a movable support for said coating carrier for moving said coating carrier into and out of contact with said workpiece on said impression cylinder; and a movable support for said roller means for moving said roller means into and out of contact with said coating surface on said coating carrier; said coating carrier and said roller means being integrated into a unitary assembly; said method comprising:

a) independently actuating said coating carrier movement on the one hand and said roller movement on the other hand;

b) independently adjusting pressure between said coating surface on said coating carrier and said workpiece on said impression cylinder and pressure between said roller means and said coating surface on said coating carrier; and c) integrating said impression cylinder with said assembly, such that a change in pressure between said coating surface on said coating carrier and said workpiece on said impression cylinder, or actuation of said carrier into and out of contact with said workpiece, does not alter pressure between said roller means and said coating carrier; and such that a change in pressure between said roller means and said coating surface on said coating carrier, or actuation of said roller means into and out of contact with said coating surface on said coating carrier, does not alter pressure between said coating surface on said coating carrier and said workpiece on said impression cylinder.

44. The apparatus of claim 4, wherein said coating carrier is a coating blanket cylinder or a coating plate cylinder.

45. The apparatus of claim 4, wherein said coating carrier presents a gapped coating surface to said impression cylinder as said impression cylinder rotates, and said printing ink carrier presents a gapped printing surface to said impression cylinder as said impression cylinder rotates, said coating surface (including said gap therein) having a perimeter substantially equal to the perimeter of said printing surface (including said gap therein).

46. The apparatus of claim 4, wherein the coating carrier is a coating plate cylinder carrying a plate.

47. The apparatus of claim 4, wherein the impression cylinder is a standardly supplied impression cylinder supporting a workpiece being printed on a lithographic printing press unit.

48. The apparatus of claim 16 wherein said adjustable stop includes stops and screws for adjusting pressure between said coating surface on said coating carrier and said workpiece on said impression cylinder, associated with means to limit pressure therebetween.

49. Coating apparatus operating on line with an impression cylinder of a lithographic printing press to apply liquid coating to a workpiece, said press having at least one ink carrying surface for applying ink to said workpiece prior to coating, said coating apparatus comprising: a) a coating carrier adapted to carry a resilient coating surface in rotative pressure contact with said workpiece supported by said impression cylinder; b) a roller means for metering and transferring a uniform predetermined quantity of coating to said resilient coating surface on said coating carrier; c) coating supply means operatively associated with said roller means; d) a movable support for said coating carrier for moving said coating carrier into and out of contact with said workpiece on said impression cylinder; e) a movable support for said roller means for moving said roller means into and out of contact with said coating surface on said coating carrier; f) means for independently actuating said coating carrier movement on the one hand and said roller movement on the other hand; g) means for independently adjusting pressure between said coating surface on said coating carrier and said workpiece on said impression cylinder and pressure between said roller means and said coating surface on said coating carrier; h) means for integrating said impression cylinder with said assembly, such that a change in pressure between said coating surface on said coating carrier and said workpiece on said impression cylinder, or actuation of said carrier into and out of contact with said workpiece, does not alter pressure between said roller means and said coating carrier; and such that a change in pressure between said roller means and said coating surface on said coating carrier, or actuation of said roller means into and out contact with said coating surface on said coating carrier, does not alter pressure between said coating surface on said coating carrier and said workpiece on said impression cylinder;

said coating carrier and said roller means being integrated into a unitary assembly.

* * * * *